US006516531B2

(12) United States Patent
Woerlein et al.

(10) Patent No.: US 6,516,531 B2
(45) Date of Patent: Feb. 11, 2003

(54) METHOD OF INSTALLING A BATHTUB AND A TEMPLATE THEREFOR

(76) Inventors: Gerhard Woerlein, 87 Daphne Crescent, Barrie, Ontario (CA), L4M 2Y7; Sandy Lee, 253 Frank Endean Road, Richmond Hill, Ontario (CA), L4S 2C4

( * ) Notice: Subject to any disclaimer, the term of this patent is extended or adjusted under 35 U.S.C. 154(b) by 0 days.

(21) Appl. No.: 09/940,508

(22) Filed: Aug. 29, 2001

(65) Prior Publication Data

US 2002/0023363 A1 Feb. 28, 2002

(30) Foreign Application Priority Data

Aug. 31, 2000 (CA) ..... 2317242

(51) Int. Cl.[7] ..... G01B 3/14
(52) U.S. Cl. ..... 33/562; 33/645; 33/333
(58) Field of Search ..... 33/562, 520, 613, 33/644, 645, 666, 670, 671, 563, 566, 333

(56) References Cited

U.S. PATENT DOCUMENTS

| | | | | | |
|---|---|---|---|---|---|
| 873,352 | A | * | 12/1907 | Diehl | 33/562 |
| 1,159,395 | A | * | 11/1915 | Kohler | 33/562 |
| 1,879,624 | A | * | 9/1932 | Lockwood | 33/563 |
| 3,389,474 | A | * | 6/1968 | Linn | 33/562 |
| 3,614,793 | A | | 10/1971 | Nemiroff | |
| 4,043,853 | A | | 8/1977 | Saladino | |
| 4,067,071 | A | | 1/1978 | Altman et al. | |
| 4,158,585 | A | | 6/1979 | Wright | |
| 5,200,257 | A | | 4/1993 | Gatarz et al. | |
| 5,392,524 | A | * | 2/1995 | Hill | 33/563 |

FOREIGN PATENT DOCUMENTS

| | | |
|---|---|---|
| CA | 2145725 | 9/1995 |

* cited by examiner

*Primary Examiner*—Christopher W. Fulton
(74) *Attorney, Agent, or Firm*—Dennison, Schultz & Dougherty

(57) ABSTRACT

The invention relates to a template for renovating a first bathtub connected to an existing drain by cutting a hole in the first bathtub and inserting a second bathtub having a bowl, a deck and a drain hole, the template comprising: a reference frame; a drain locating member movable in relation to the frame; a level indicating means to indicate verticality of the drain locating member; a member contact point on the frame for contact with the drain locating member; a stencil means on the frame corresponding to at least a part of an outline of the rim of the bowl of the second bathtub; wherein the contact point and the stencil means are arranged so that when the drain locating member is vertical and in contact with the contact point, cutting the outline of the first bathtub according to the stencil will provide a hole which when the second bathtub is inserted will bring the drain hole adjacent with the existing drain. For convenient execution of the method there is also provided a method of replacing a first bathtub having a bowl and a deck and connected to an existing drain by a second bathtub having a bowl, a deck and a drain hole which method comprises: cutting a hole in the first bathtub, the hole being large enough to accommodate the bowl of the second bathtub and to remove substantially all of the bowl of the first bathtub; disconnecting the first bathtub from the existing drain; removing the portion of the first bathtub cut by the hole including substantially all of the bowl thereof; inserting the second bathtub into the hole so that the drain hole is adjacent the existing drain.

10 Claims, 2 Drawing Sheets

METHOD OF INSTALLING A BATHTUB AND A TEMPLATE THEREFOR

The invention relates to methods of installing bathtubs and a template therefor.

A bathtub may be considered as having two components, a bowl which is the part of the bath to hold the water and a deck which forms a flat shoulder around the bowl. Usually these two components are integral and merge at the top of the bowl. When a bathtub is placed against a wall, it is the deck portion which will abut the wall.

A common type of bathtub is generally rectangular in plan view, having two long sides and two short sides. A user would usually sit in the tub along the longer dimension with feet at one end and body and head at the other end. The fittings, such as the faucets, the overflow spout and the drain spout would usually be at the foot end of the tub (hereinafter some referred to as the valve end since it is the end nearest the plumbing for the drain and faucets). The other end is referred to as the head end. Usually bathtubs are placed longwise against a wall so that at least one of the two long sides is adjacent a wall. Usually the other long side is open, and not near a wall, to permit easy access to the tub. The long side which is adjacent a wall is referred to as the back side.

Some bathtubs present special problems of replacement. For example, older bathtubs may be of iron and set against at least one wall in the bathroom. Thus the old bath cannot be removed without damaging at least one wall. This seriously increases the work required and the cost to replace the bathtub. One way around this problem is to leave the existing bathtub in place and put the new bathtub inside it. Usually the parts of the old tub around the drain hole and overflow hole are cut away to make room for corresponding fittings for use with the new bathtub. It is usually preferable to keep the old plumbing fixtures such as the drain and the pipes leading to the faucets.

A problem with using the frame of an older bathtub is that the new tub must be of similar, even smaller dimensions to fit into the old tub and usually the new tub ends up being smaller than the old tub. Since old tubs are often smaller than the sizes which are preferred by today's standards, any size reduction is a disadvantage. Also, it is usually difficult to level the new tub since it must necessarily take its configuration from the old tub frame.

Another problem is to "centre" the new bathtub. Centring the bathtub means to make sure it is positioned so that the new outflow and overflow holes will fit with the old drain system. Most of the old tub is kept in order to be able to "centre" the old tub.

There has now been found an improved method of renovating an old bath and a template to assist in centring a new bath in an old tub.

According to one aspect of the present invention there is provided a template for renovating a first bathtub connected to an existing drain by cutting a hole in the first bathtub and inserting a second bathtub having a bowl, a deck and a drain hole, the template comprising: a reference frame; a drain locating member movable in relation to the frame; a level indicating means to indicate verticality of the drain locating member, a member contact point on the frame for contact with the drain locating member; a stencil means on the frame corresponding to at least a part of an outline of the rim of the bowl of the second bathtub; wherein the contact point and the stencil means are arranged so that when the drain locating member is vertical and in contact with the contact point, cutting the outline of the first bathtub according to the stencil will provide a hole which when the second bathtub is inserted will bring the drain hole adjacent with the existing drain.

According to another aspect of the present invention there is provided a method of replacing a first bathtub having a bowl and a deck and connected to an existing drain by a second bathtub having a bowl, a deck and a drain hole which method comprises: cutting a hole in the first bathtub, the hole being large enough to accommodate the bowl of the second bathtub and to remove substantially all of the bowl of the first bathtub; disconnecting the first bathtub from the existing drain; removing the portion of the first bathtub cut by the hole including substantially all of the bowl thereof; inserting the second bathtub into the hole so that the drain hole is adjacent the existing drain.

The first bathtub is usually the old bathtub and the second bathtub is usually a new bathtub.

The template comprises a frame. A sheet of wood such as plywood is suitable. The frame only needs to provide a fixed reference for certain measurements and arrangements. The frame is for positioning on top of the old bathtub.

Adapted to cooperate with the frame is a drain locating member. This may be a stick or tube or other straight member. The drain locating member cooperates with the frame for example by having a hole in the frame, when it is a plywood sheet for example, through which the drain locating member can slide up and down and left to right. The drain locating member must be long enough to reach the drain.

The level indicating means is conveniently a bull's eye level affixed to the top of the drain locating member. With the aid of the level, and keeping a bottom end or the drain locating member in the drain, the drain locating member can be ensured to be vertical.

The member contact point is a reference point on the frame. It is arranged so that by assuring the drain locating member is vertical and in contact with the member contact point, the stencil means will enable marking a hole which when cut will allow the new bathtub to be correctly positioned with drain hole adjacent the existing drain. Conveniently, there is at least one hole carefully located in the frame through which the drain locating member can slide up and down (with a little extra room for a small angular movement to facilitate locating the existing drain and bringing the drain locating member to a vertical position). The member contact point on the frame would then be any point on the rim of that hole which can contact the drain locating member for proper positioning of the stencil means. If the hole is too small the drain locating member will not be able to move freely. If the hole is too large, then there may be too much variation in the placement of the stencil for producing a properly placed hole for proper placement of the drain hole.

Stencil means in the frame enable marking the old bathtub so that it may be properly cut to accommodate the new bathtub. Thus the stencil represents the widest cross-section of the bowl of the new bathtub so that when the old bathtub is cut according to the stencil, a hole is formed which will accommodate the bowl portion of the new bathtub. The deck of the new bathtub will then be above the deck of the old bathtub.

The hole in the frame (to accommodate the drain locating member) together with the stencil, represent fixed reference points with regard to the new bathtub. Thus when the drain locating member is vertical, as indicated by the level, and while it is level, the old bathtub is marked according to the stencil, then when the old bathtub is cut as marked, and the new bathtub inserted, the drain hole of the new tub will be correctly positioned for connection to the existing drain.

The template preferably has other attachments. It is preferred that the template has vertically adjustable mounting means at each corner. Such adjusting means may be a screw threaded bolt so that the head will rest on the deck of the old bathtub and the thread will pass through a nut attached to the template at a corner. By screwing the bolt up and down, the height of that corner may be varied in relation to the old bathtub deck. By having such an adjustable means at each corner, the template can be adjusted to be substantially level. By measuring the length of the bolts at each corner, it is then possible to know the height of support inserts to put on the old deck to ensure that the new bathtub will be level.

It is also preferred to have horizontal positioning means along the sides of the template adjacent any existing walls. Such horizontal positioning means may be a screw threaded bolt attached to the template by a nut so that screwing the bolt in or out extends or retracts the bolt with relation to a side of the template. Thus when the template is level, and positioned correctly, the horizontal positioning means at each of the two ends adjacent a wall can be screwed out until the head of the bolt touches the wall. When the wall is touched, the length of the bolt extending beyond the template gives a measurement by which a deck of the new bathtub can be cut for a snug fit to that wall. Such horizontal positioning means may be on all four sides although usually not more than three sides of the new bathtub would need to be flush with adjacent walls.

A new bathtub to replace an old bathtub is preferably a bathtub with a large deck to accommodate any renovation situation. Such a bathtub might be, for example, a luxury acrylic soaker tub reinforced with fibreglass. Most old steel bathtubs have a water depth of about 10.5 inches whereas such a luxury bathtub may have water depths of 11.75 inches to 13 inches and even up to or greater than 17 inches. The deck, is the flat horizontal top surface, above and outside the tub, which is intended to abut any adjacent walls. The deck provides protection from water entering between the bathtub and the wall and collecting under the tub. New bathtubs for retrofitting old bathtubs, therefore preferably have a large deck which will be cut back to fit the particular dimensions of the new location.

The invention will be further illustrated with reference to the accompanying drawings in which.

Figure 1:
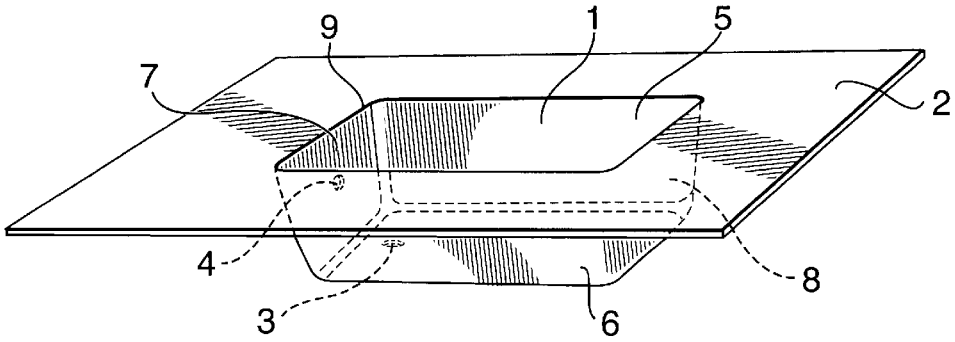
FIG. 1 is a schematic perspective representation of a new bathtub for use in a retrofit according to the present invention.

FIG. 1 shows a new bathtub having a bowl 1 and a deck 2. The deck is intended to abut any adjacent walls at the location of the renovation. Since the position of the old tub in relation to its adjacent walls will vary from jobsite to jobsite, deck 2 is preferably large enough to accommodate any foreseen situation. By measurement explained hereinafter, the deck is intended to be cut back to fit the dimension of the particular bath location at the jobsite. The bath is already equipped with drain hole 3 and overflow hole 4. It can been seen that bowl 1 has an inside surface 5 which would be in contact with any water in the tub and an outside surface 6 which would not normally be visible after installation and would not contact the bathwater. The fittings 3 and 4 are located at the foot or valve end 7 and the other end 8 is the head end. The edge 9 of the bowl represents a profile which provides the largest cross-section of the bowl for ease of installation. That is, provided an opening is made which is at least as large as the profile formed by edge 9 (plus a small increment represented by the thickness of the bowl wall) then the entire bowl will pass freely through that opening until the opening encounters the larger surface of the deck 2.

Figure 2:
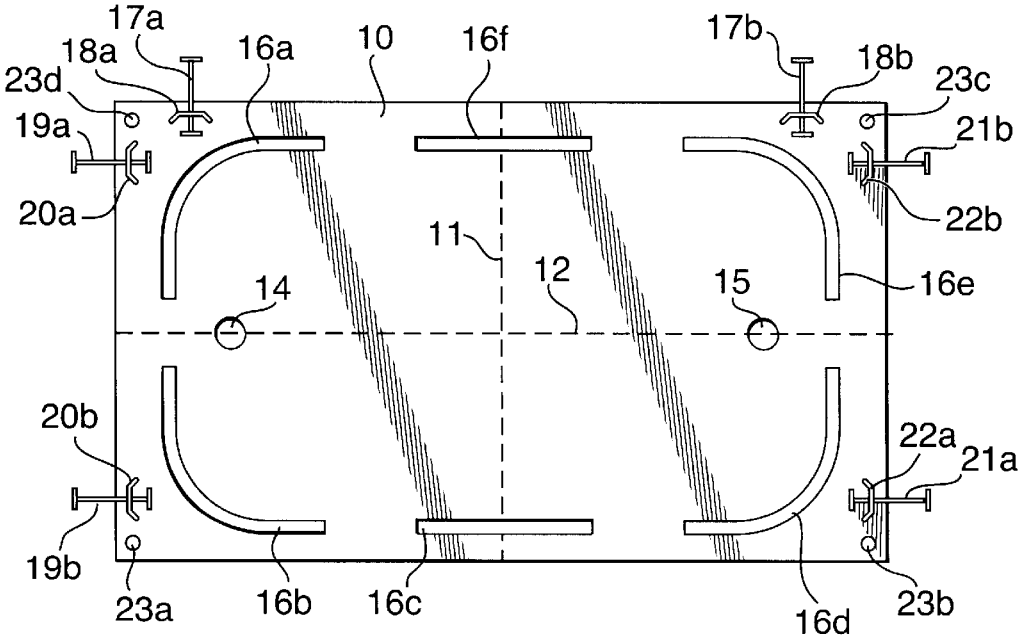
FIG. 2 is a schematic plan view of a template according to the present invention without a drain locating member.
Figure 3:
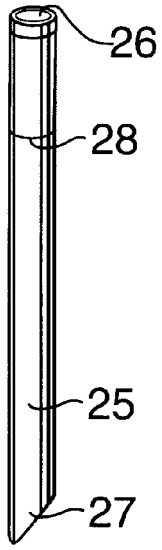
FIG. 3 is a schematic perspective view of a drain locating member for use with the template of FIG. 2.

FIGS. 2 and 3 show a template according to the invention. FIG. 2 shows a frame which is conveniently a sheet of plywood, but may be of any other suitable material to provide fixed reference points. Lines 11 and 12 are "cross-hairs" and are preferably marked on the template to indicate the centre lines of the new tub in both the longer axis and the shorter axis. Holes 14 and 15 are provided for the drain locating means (shown in FIG. 3). Only one of these holes is needed for a given job since there is only one existing drain and only one drain hole in the new bath. Which of the two holes is used will therefore depend upon the orientation of the existing drain at the jobsite and which way round the bath will be placed. Slots 16*a* to 16*f* provide stencil means. They are wide enough to accommodate a felt-tipped pen or other marking device, so that a surface below frame 10 can be marked with the same shape as defined by slots 16*a* to 16*f*.

Slots 16*a* to 16*f* are sufficient to provide an outline of the bowl rim 9 (FIG. 1) including the thickness of the new bowl. Screw threaded bolts 17*a* and 17*b* are threadedly attached to brackets 18*a* and 18*b*. These bolts provide adjustable wall sensors which act as an easy means to obtain a measurement to an adjacent wall, since they may be extended or retracted in relation to frame 10 by screwing them in or out. Similarly bolts 19*a* and 19*b* (threaded in brackets 20*a* and 20*b*), and bolts 21*a* and 21*b* (threaded in brackets 22*a* and 22*b*) provide an easy means to obtain measurements to their respective walls if required. 23*a* to 23*d* show the location of levelling means (see 23*a* and 23*b* in FIG. 4). In a preferred embodiment 23*a* to 23*d* are screw bolts threaded in nuts (not shown) mounted on frame 10.

FIG. 3 shows a drain locating member 25. Member 25 is straight and may be a peg or hollow tube or other cylinder. At its top end there is preferably a bull's eye level 26 to indicate verticality of the member. Other means may be used to indicate verticality. End 27 is intended to locate the drain and is inserted into the drain at a jobsite. A mark 28 is conveniently placed on the member to indicate the height needed for the new tub. This height should represent at least the height from the bottom of the bowl to its rim so that when the new tub is installed, the drain does not press up into the bowl and damage it. The member 25 should be of cooperating dimension with the holes 14 and 15 (FIG. 2) so that it is a snug fit but is free to move up and down and also allows some angular movement.

Figure 4:
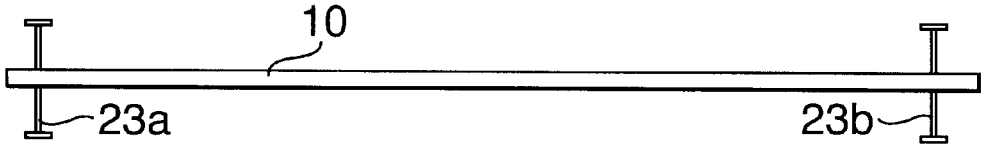
FIG. 4 is a schematic side view of FIG. 2.

FIG. 4 shows a side view of frame 10 showing two of the four levelling bolts 23*a* and 23*b*.

In practice, two marks are made on the deck of the old tub. At the valve end of the bathtub, a mark is made which corresponds to the distance from the adjacent wall (the wall which abuts the back side of the old tub, i.e. the wall which is normally parallel to the length of a user in the bathtub) to the overflow hole. This mark is made on the deck, at the same distance from the adjacent wall at both ends of the tub. Thus these two marks represent a "centre" line of the tub. Thus when the template is put on the old tub, the long cross-hair 12 is lined up with these centre-line marks on the old tub to ensure that the new tub will be centred with the existing fittings and in relations to the existing adjacent wall.

In operation, the frame 10 is placed on top of the old tub. Depending on the orientation of the old tub in relation to the existing drain, either hole 14 or hole 15 is chosen to insert the drain locating member 25. Cross-hair 12 is used to provide centring of the frame as described above. The drain locating end 27 of drain locating member 25 is inserted into the existing drain so it can rest there. Then, using a level indicating means such as bull's eye level 26, drain locating member 25 is moved into a vertical orientation, keeping the drain locating end 27 resting in the drain, which effectively uses the drain as a pivot Since the drain locating member 25 is in moveable attachment with frame 10 by way of hole 14 or 15, movement of the member 25 correspondingly moves the frame 10. Because the stencil means, for example slots 16*a* to 16*f* is in fixed relation to holes 14 and 15, it can be seen that when member 25 is vertical with end 27 resting in the drain and passing through one of holes 14 or 15, then the rim 9 of the new tub, represented by stencil slots 16*a*–16*f*, is in a proper placing for the drain hole of the new bath to be readily connected to the existing drain. The slots 16*a*–16*f* are then used to mark the old tub with a suitable marking device such as a felt-tipped pen. The old tub is then cut according to the marks, and the entire cut-away part, which will usually include substantially all of the old bowl, is discarded leaving a hole just large enough to accommodate the new bowl. Cutting out more than or substantially all the bowl of the old bathtub also allows easy and convenient access to the floor and existing drain assembly. In the broadest embodiment, it is only necessary to locate the drain in relation to the old and new tub to obtain a convenient fit of the new tub. This means that the template only needs a reference frame with a drain locating member movably attached, a level indicator to indicate that the drain locating member is vertical and stencil means to mark a profile which when cut will allow the new bath to be installed in appropriate placement for connection to the existing drain.

In practice, it is preferred to fit a tub surround flush to any adjacent walls around the old tub. Such flush fitting is conveniently achieved by use of measuring means such as measuring bolts 17*a*, 17*b*, 19*a*, 19*b*, 21*a* and 21*b*. Using a back wall as an example, the back wall would be adjacent bolts 17*a* and 17*b* threaded in brackets 18*a* and 18*b*. While maintaining the template in position, with drain locating end 27 in the drain and drain locating member 25 in a vertical position through hole 14 or 15, bolts 17*a* and 17*b* are adjusted until they extend out far enough to touch the adjacent wall. Similar adjustments are made, as required, for bolts 19*a* and 19*b* and bolts 21*a* and 21*b* for their respective adjacent walls.

The template is then transferred to the new bath. Positioning is repeated but this time the drain locating end 27 is centred and held in the drain hole 3 of the new tub. The drain locating member, while passing through hole 14 or 15 of the template, is adjusted to be vertical. The template is further centred using the cross-hair lines 11 and 12. Then the tub deck 2 is marked according to the measurements at bolts 17*a*, 17*b*, 19, 19*b*, 21*a* and 21*b* and cut accordingly. This enables a flush fit of the tub deck to the walls of the new location.

It is also preferred to customize the height. Firstly, as previously mentioned, it is best that the new tub does not press down on the existing drain so that the bath will be damaged. Of course, if the tub of the new bath is much shallower than the tub of the old bath, this would be unlikely, since the tub deck would prevent the bottom of the new tub from reaching the depth of the bottom of the old tub. However, in practice, the old tub is usually more shallow than modem taste dictates and generally it is preferred to use a new tub which is at least as deep as, and preferably deeper than the old tub. Thus the drain locating member is marked to indicate a safe height for the frame which corresponds to a depth greater than the depth of the new tub.

Secondly, it is preferable to ensure that the new tub is substantially level. In prior art systems such levelling when using part of an old bath, was not possible or not practical. Such prior art systems had to put the new tub onto the old tub and accept the resulting orientation.

In the system according to the invention, levelling is achieved conveniently by levelling means, represented by bolts 23*a* to 23*d*. While the template is in position over the old tub, with drain locating end 27 resting in the drain and drain locating member 25 vertical and passing through hole 14 or 15, bolts 23*a* to 23*d* are adjusted until frame 10 is both level and at or above the line 28 on drain locating member 25. For this levelling of frame 10, separate levelling means would be used such as a conventional spirit level. When levelling is complete, the location of each bolt on the old bath is noted with the associated height. The top of the old bath is then modified by adding an appropriate height of suitable support material such as wooden blocks. The height or positioning of the deck of the new bathtub can also be transferred by directly marking the wall corresponding to the position of the template when the template is in a desired or levelled position.

The new bath, with deck which is now custom-trimmed is then inserted into the hole in the remains of the old bath. Positioning can also be assisted by use of the template again. A firm placing can preferably be enhanced by application of a layer of foam adhesive to the top of the old bath, or to the top of the support material affixed to it. The drain can then be connected to the new drain hole and overflow hole by standard fittings.

As part of normal installation, a foundation is usually installed under the new bathtub. The foundation would normally be cement or concrete.

In this way, the template of the invention permits ready installation of a new tub, even when the new tub is larger than the old tub, using part of an existing tub and further permits accurate placing of the tub including levelling.

What is claimed is:

1. A template for renovating a first bathtub connected to an existing drain by cutting a hole in the first bathtub and inserting a second bathtub having a bowl, a deck and a drain hole, the template comprising:

a reference frame;

a drain locating member movable in relation to the frame;

a level indicating means to indicate verticality of the drain locating member, a member contact point on the frame for contact with the drain locating member;

a stencil means on the frame corresponding to at least a part of an outline of the rim of the bowl of the second bathtub;

wherein the contact point and the stencil means are arranged so that when the drain locating member is vertical and in contact with the contact point, cutting the outline of the first bathtub according to the stencil will provide a hole which when the second bathtub is inserted will bring the drain hole adjacent with the existing drain.

2. A template according to claim 1 further comprising frame levelling means.

3. A template according to claim 2 wherein the frame is a sheet of semi-rigid material, the drain locating member is a cylinder having first and second ends, the level indicating means is a bull's eye level attached to a first end of said drain locating member, the member contact point is a point on a rim of a hole in the frame and the stencil means is a plurality of slots in the frame.

4. A template according to claim 3 further comprising at least two adjustable wall sensors on a side of the template adjacent an existing wall, spaced apart such that when they are extended to touch the existing wall they record a measurement enabling trimming of the deck of the second bathtub to fit flush with the existing wall.

5. A method of replacing a first bathtub having a bowl and a deck and connected to an existing drain by a second bathtub having a bowl, a deck and a drain hole which method comprises:

cutting a hole in the first bathtub, the hole being large enough to accommodate the bowl of the second bathtub and to remove substantially all of the bowl of the first bathtub;

disconnecting the first bathtub from the existing drain;

removing the portion of the first bathtub cut by the hole including substantially all of the bowl thereof;

inserting the second bathtub into the hole so that the drain hole is adjacent the existing drain.

6. A method according to claim 4 further including the step of using a template to mark an outline for cutting said hole in the first bathtub wherein the template is arranged so that when the hole is cut according to the outline, inserting the bowl of the second bathtub into the hole will bring the drain hole adjacent the existing drain.

7. A method according to claim 5 wherein the template comprises:

a reference frame;

a drain locating member movable in relation to the frame; a level indicating means to indicate verticality of the drain locating member; a member contact point on the frame for contact with the drain locating member;

a stencil means on the frame corresponding to at least a part of an outline of the rim of the bowl of the second bathtub;

wherein the contact point and the stencil means are arranged so that when the drain locating member is vertical and in contact with the contact point, cutting the outline of the first bathtub according to the stencil will provide a hole which when the second bathtub is inserted will bring the drain hole adjacent with the existing drain.

8. The method of claim 7 wherein the template further comprises frame levelling means.

9. The method of claim 8 wherein the frame is a sheet of semi-rigid material, the drain locating member is a cylinder having first and second ends, the level indicating means is a bull's eye level attached to a first end of said drain locating member, the member contact point is a point on a rim of a hole in the frame and the stencil means is a plurality of slots in the frame.

10. The method of claim 9 wherein the template additionally comprises at least two adjustable wall sensors on a side of the template adjacent an existing wall, spaced apart such that when they are extended to touch the existing wall they record a measurement enabling trimming of the deck of the second bathtub to fit flush with the existing wall.

* * * * *